United States Patent [19]

Porth

[11] 4,102,266

[45] Jul. 25, 1978

[54] SQUEEGEE, INK SCOOP AND FLOOD BLADE ASSEMBLY

[75] Inventor: Frank L. Porth, Morley, Mich.

[73] Assignee: James A. Black, Kent City, Mich.

[21] Appl. No.: 778,867

[22] Filed: Mar. 18, 1977

[51] Int. Cl.[2] ..... B41F 15/44; B41F 15/46

[52] U.S. Cl. ..... 101/124

[58] Field of Search ..... 101/123, 124; 118/213, 118/406, 413, 415

[56] References Cited

U.S. PATENT DOCUMENTS

| | | | |
|---|---|---|---|
| 2,739,530 | 3/1956 | McLaurin | 101/123 |
| 2,881,698 | 4/1959 | Graham | 101/123 |
| 3,973,490 | 8/1976 | Black | 101/124 |

*Primary Examiner*—Ronald E. Suter

*Attorney, Agent, or Firm*—Price, Heneveld, Huizenga & Cooper

[57] ABSTRACT

Stencilling apparatus having a trough-type fluid scoop ahead of the squeegee and pivotally shiftable in a rearward direction from a fluid dumping position, through a sweeping fluid scooping action adjacent the screen, to a fluid retention position in engagement with the squeegee.

4 Claims, 7 Drawing Figures

SQUEEGEE, INK SCOOP AND FLOOD BLADE ASSEMBLY

BACKGROUND OF THE INVENTION

This invention relates to stencilling, and more particularly to stencilling apparatus having a fluid scoop trough forwardly of, adjacent to, and cooperative with the squeegee.

In the performance of stencilling operations using a stencil screen and a squeegee, a coating or layer of ink or other stencil fluid is typically placed on the screen such that relative movement between the screen and squeegee forces some of the fluid through the screen interstices onto the underlying stock. To assure an effective amount of fluid being forced through the screen, an excess of fluid is coated on the screen. During the stencilling stroke, the excess is pushed ahead of the squeegee to the end of the stencil and stencil frame where it accumulates after repeated stencilling strokes. The liquid carrier of the accumulated fluid tends to evaporate, causing the remaining solids to dry up and build up disadvantageously. While stencilling apparatus has been developed wherein this problem is not encountered, by the use of a submersible element as in U.S. Pat. No. 3,980,017, it is sometimes desirable to employ a conventional, nonimmersible squeegee, e.g. on a stencil press having a cylindrical stock support drum.

SUMMARY OF THE INVENTION

The present invention effectuates stencilling apparatus wherein excess fluid pushed ahead of a squeegee is uniquely scooped up at the end portion of the stencilling stroke.

A trough-type scoop parallel to the squeegee is pivotally actuated to sweep through a scooping motion from a first position, through the pivotal scooping motion, to a second position at which the scooped fluid is retained for the return stroke.

The apparatus can be combined with a conventional squeegee, without excessive expense, to minimize fluid build-up at the end of the stencil.

These and other features, advantages and objects of this invention will be apparent upon studying the following specification in conjunction with the drawings.

DESCRIPTION OF THE PREFERRED EMBODIMENT

Figure 4:
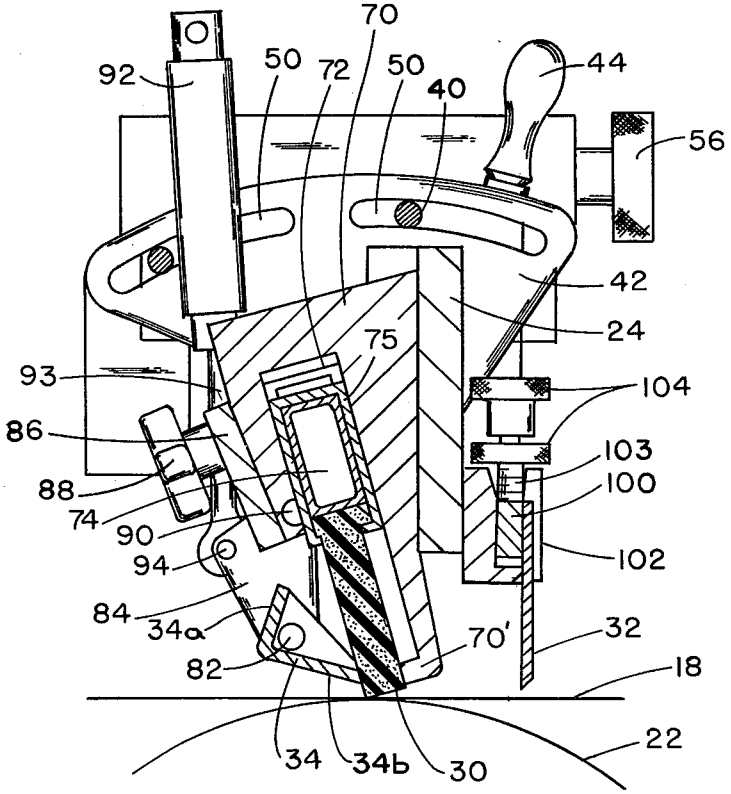
FIG. 4 is a sectional view taken on plane IV—IV of FIG. 3.

Referring now specifically to the drawings, the stencil screen press assembly 10 includes several conventional stencil press components such as a support frame subassembly 12, part of which is depicted, upon which is rotationally mounted a support cylinder 22 in conventional fashion to form a peripheral stock support surface (FIG. 4), such being rotated successively through a controlled arc in a conventional manner such as set forth in detail for example in U.S. Pat. Nos. 2,602,492, 2,866,405 or 2,917,997.

Positioned above the crest of the cylinder is a squeegee subassembly 14 which is cooperative with an underlying, reciprocating, stencil support frame 16. Frame 16 mounts a stencil screen 18 in conventional fashion, and is supported on a travelling reciprocating carriage of conventional type to move back and forth beneath the squeegee. Thus, relative movement is caused to occur between longitudinally travelling stencil screen and the longitudinally stationary squeegee and support cylinder, by advancing the screen between the squeegee and the cylinder while web stock is advanced with the rotating cylinder. Web or sheet stock is fed into the press by suitable conveyance means, and is removed from the press as on suitable vacuum belts 20 or the like in conventional fashion. The squeegee is vertically shifted as described hereinafter to be lowered for the stencilling stroke and elevated during the return stroke.

Squeegee subassembly 14 is supported above the crest of the cylinder by a squeegee support bar or mount 24, the ends of which are on a pair of support posts 61 vertically movable at side mounts 26 in a lifting or lowering action by conventional mechanism of the type set forth for example in U.S. Pat. No. 3,120,180. This squeegee subassembly thus has its elongated dimension transverse to the direction of stock flow and screen movement, and parallel to the axis of the underlying support surface cylinder.

Suspended indirectly from support bar 24 are three important components, namely the squeegee 30, the flow coater or doctor blade 32 therebehind (relative to stock and screen movement during the printing stroke), and a trough-shaped ink scoop and retaining device 34 in front of the squeegee, i.e. on the opposite face of the squeegee from flow coater 32. These are supported by an elongated support bar 24, the ends of which are attached by bolts 25 to a pair of stub elements 27 projecting from a pair of respective vertical plates 42. Plates 42 are secured to abutting plates 46 by Allen bolts or screws 40. Plates 46 are integral with end support webs 59 attached to slide collars 62. Collars 62 rest on guide tracks **60*a* of yoke 60 attached to upright posts 61**.

The particular angular relationship of the squeegee subassembly to screen 18 can be varied by special graduated adjustment mechanism on both ends of the squeegee subassembly so as to accommodate the type of stencilling needed. More particularly, adjustment can be achieved by loosening set screws 40 on both ends of the assembly, and causing arcuate movement of like plates 42 with handles 44, relative to fixed support plates 46. This pivots the squeegee assembly. The screws 40 guide the movement by sliding in arcuate slots 50 in plates 42 (FIG. 4). These arcuate slots have a center of curvature at the lower, screen engaging edge of squeegee element 30 so that angular adjustment of element 30 relative to the screen and cylinder does not move the squeegee tangentially of the cylinder, i.e. does not shift the squeegee edge longitudinally of the press. Scale markings on the adjacent plates enable selected positioning.

Controlled longitudinal adjustment of the squeegee element relative to the drum is by the pair of horizontal adjustment screws 54 on opposite ends of the subassembly, each with a knob 56. Both ends of each screw 54 are rotationally mounted in the legs of yokes 60. Yokes 60 each have a vernier scale **60*b* (one of which is shown) centrally thereof to indicate position. The threaded portions of screws 54 are threadably interengaged with threaded collars 62. Thus, the bolts or screws 63 are loosened, and knob 56 is rotated to turn screw shaft 54 for adjustment, followed by retightening of bolts 63**.

Suspended from support bar 24 is squeegee housing 70 (FIG. 4) which incorporates a downwardly opening cavity 72 retaining resilient squeegee element 30 projecting downwardly therefrom and, immediately thereabove, a fluid-containing tubular bladder 74 engaging the upper edge of squeegee element 30, to cause the lower edge of the squeegee element to have a uniform pressure against screen 18. Bladder 74 is within a retainer 75. The back side of the lower portion of squeegee 30 is reinforced by a projecting flange 70' of housing 70.

Suspended in front of the squeegee forward face is the trough-shaped, pivotal, fluid scooping and retaining element 34. It includes two legs **34*a* and 34*b* basically normal to each other. The opposite ends of this trough-shaped element include stub pins 82 affixed to suspension brackets 84. The upper ends of brackets 84 are pivotally attached on pivot pins 90 to a scoop-mounting bar 86. Mounting bar 86 is secured to the forward face of squeegee housing 70 by a pair of knob and screw elements 88. Brackets 84 actually constitute cranks 84 with pins 90 on the upper end portions thereof, to be pivotable thereabout and thereby shift scoop 34 through a sweeping motion in a manner to be described. This shifting action is achieved by a fluid cylinder 92, e.g. air cylinder, having the lower end of the piston rod pivotally attached by pin 94 to one of the cranks 84 (FIG. 4). The upper end of cylinder 92 is attached to a cantilever bracket 96 in turn secured by plate 98 to one end web of the support bar for the squeegee assembly. Contraction of the fluid cylinder causes scoop 34 to be moved away from squeegee 30 into an inverted dumping position elevated above screen 18. Extension of fluid cylinder 92 shifts scoop 34 from an inverted nonretaining position, through a scooping action at which time the lower edge portion of leg 34*b* sweeps down adjacent screen 18** to scoop excess stencil fluid, e.g. ink from in front of the squeegee, and then into engagement with the forward face of the squeegee blade to retain the fluid between the scoop and squeegee blade during the return stroke as explained more specifically hereinafter.

Mounted on the rear side of the squeegee is a flow coater blade 32. This blade is supported on a bracket 100 vertically shiftable in a slide 102, with a pair of typical adjusting screws 103 and collars 104. The screws are threadably engaged with bracket 100 and abut the bottom of the slide to allow vertical adjustment of the lower edge of flow coater 32 relative to the plane of screen 18. This enables the thickness of stencilling fluid coated upon the screen to be regulated. This doctor blade or flow coater may also be optionally lifted out of the range of the stencil by a linkage and cam arrangement including cam roller 110 mounted on the lower end of link 114 which is pivotally secured at pin 116 to support 24. Link 114 may be attached to another link 115 if desired. This adjustment and lifting action is not considered to be part of the invention.

Although the operation of the novel apparatus will basically be readily apparent from the above description of the apparatus, the following brief operational description is set forth to assure complete clarity.

Figure 7:
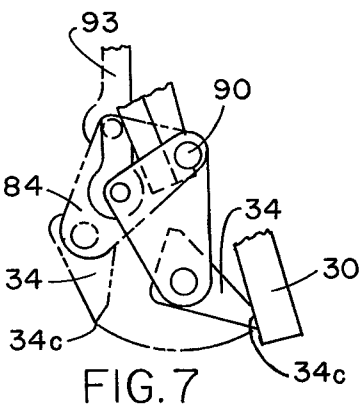
FIG. 7 is a fragmentary elevational view of the scoop and squeegee blade, showing the scooping action.
Figure 1:
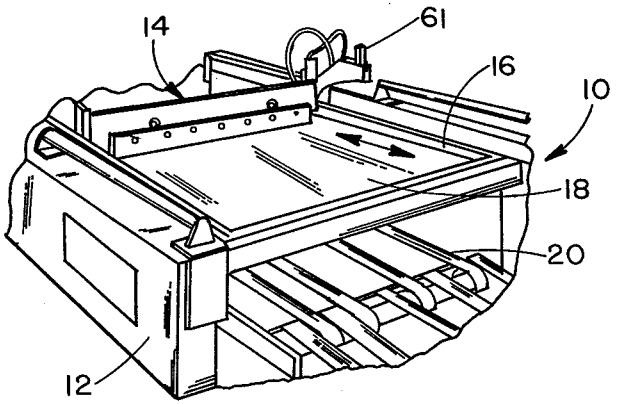
FIG. 1 is a fragmentary perspective view of a stencil press employing this invention, viewed from the discharge end of the press.
Figure 2:
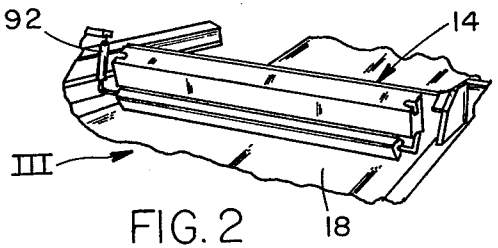
FIG. 2 is a fragmentary perspective view of the squeegee assembly in FIG. 1, but viewed from the opposite end of the press to that in FIG. 1.
Figure 5:
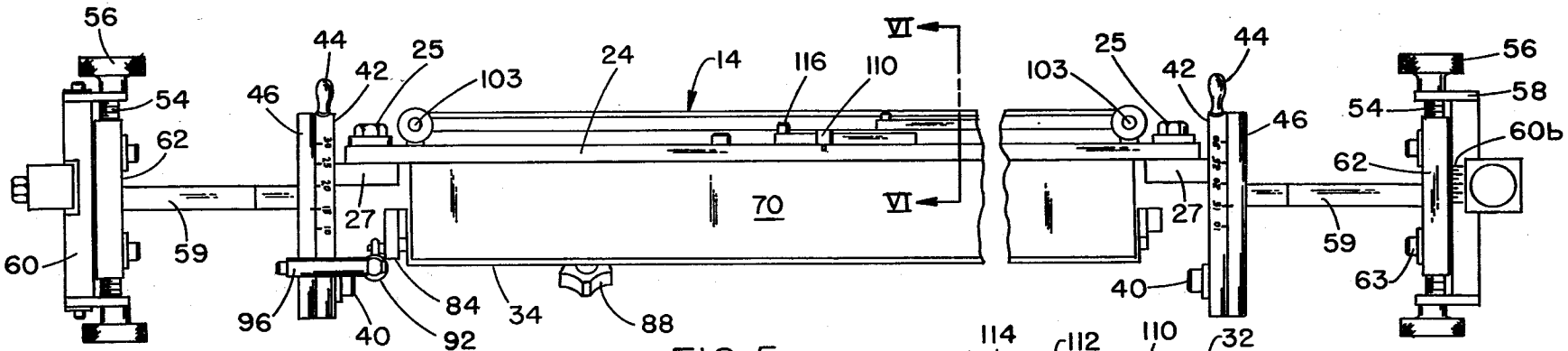
FIG. 5 is a fragmentary plan view of the squeegee assembly in FIG. 3.
Figure 6:
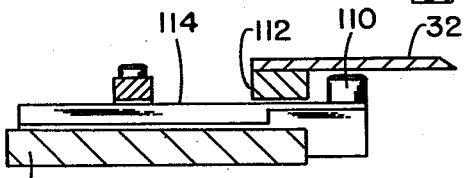
FIG. 6 is a sectional view taken on plan VI—VI of FIG. 5.
Figure 3:
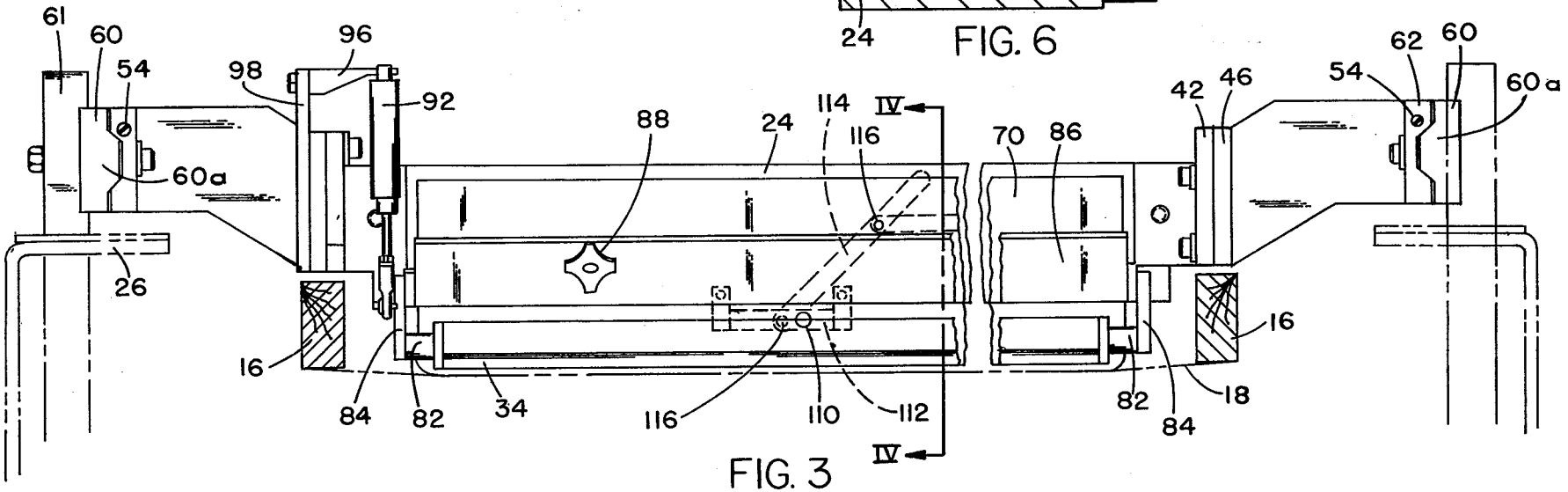
FIG. 3 is a fragmentary, elevational view of the squeegee assembly in FIG. 2, shown from the direction indicated in FIG. 2.

Assuming that a supply of stencilling fluid such as ink has been placed upon the stencil screen 18 and that sheet or web stock has been fed into the press so as to be on the support cylinder surface and beneath the stencil screen, the stencilling stroke is then begun. This proceeds with the squeegee element 30 in engagement with stencil screen 18 to force a portion of the previously coated stencilling fluid through the screen onto the underlying stock on support surface 22. This occurs as the cylinder rotates through a controlled arc beneath the screen and the screen and stock advance between the rotating cylinder and the stationary squeegee. The portion of the fluid that is not forced through the screen is pushed ahead of the squeegee as excess fluid. During this stencilling stroke, scoop 34 is in the elevated dumping condition depicted in FIG. 7 in phantom, the piston rod 93 of cylinder 92 having been vertically retracted to draw cranks 84 upwardly around pivot pins 90 and thereby retract scoop 34 to this elevated, nonretaining condition. As the stencilling stroke proceeds, the trailing flow coater blade 32 having its lower edge spaced a predetermined fraction of an inch above screen 18, applies a coating of stencilling fluid to the screen behind squeegee 30 to prepare for the next stencilling stroke. As the apparatus approaches the end of the stencilling stroke, the excess stencilling fluid ahead of the squeegee is specially scooped up by actuation of cylinder 92 which causes scoop 34 to move from the phantom line position in FIG. 7 to the solid line position in FIG. 7, the lower edge **34*c* of the scoop moving through an arc (FIG. 7) which sweeps rearwardly closely adjacent screen 18 and into abutment with the squeegee to scoop up the excess ink and retain it between scoop 34 and the forward face of squeegee element 30. The squeegee assembly is then elevated by vertical shifting of posts 61 (not element 26) for the return stroke, the excess stencilling fluid being neatly retained during this return stroke. When the stencil screen and frame reach the return, i.e. initial, position, the squeegee assembly is again lowered, at which time fluid cylinder 92 is retracted to cause scoop 34** to move away from the squeegee element and be inverted to dump the excess stencilling fluid. At the start of the stencilling stroke, the squeegee and flow coater are retained elevated until after the deposited excess fluid has moved (with the screen) behind the squeegee element and in front of the flow coater. Then the squeegee assembly drops to cause the squeegee element to engage the screen, and to cause the flow coater to be spaced a controlled fraction of an inch above the screen. The stencilling stroke then proceeds and the entire operation is repeated.

The embodiments of the invention in which an exclusive property or privilege is claimed are defined as follows:

1. A stencilling squeegee, flow coater and scoop assembly for cooperation with a stencil screen reciprocating in advance stencilling strokes and reverse return strokes, comprising:

an elongated squeegee mount and squeegee supported thereby;

a pair of spaced supports for said squeegee mount;

said squeegee mount and squeegee being vertically shiftable by said supports between a lowered stencilling position during the stencil screen advance stroke, and an elevated nonstencilling position during the stencil screen return stroke;

an elongated fluid scoop between said supports, parallel to and spaced from said squeegee;

said fluid scoop comprising a trough-type member positioned ahead of said squeegee relative to the screen advance, said fluid scoop being pivotally shiftable from a fluid dumping position, through a fluid scooping action approaching and sweeping adjacent the screen to scoop up excess fluid in front of said squeegee, to a fluid retention position, whereby excess fluid in front of the squeegee can be scooped up at the end of the stencilling stroke and retained during the return stroke, and said fluid scoop being shiftable from said fluid retention position back to said fluid dumping position whereby excess fluid can be dumped prior to lowering of said squeegee by said supports at the start of the stencilling stroke for use of the fluid during subsequent stencilling strokes; and a flow coater between said supports and behind said squeegee relative to the screen advance to flow coat the fluid dumped from said scoop into a coating of fluid on the screen during the stencilling stroke as the squeegee preceding it performs the stencilling function.

2. The apparatus in claim 1 wherein said scoop includes a scooping edge portion which sweeps in an arc downwardly toward the screen and rearwardly toward the squeegee during the scooping action and into engagement with said squeegee to effect said scoop retention position.

3. The squeegee, flow coater, and scoop assembly in claim 1 including means at said pair of supports for angularly adjusting said squeegee mount and squeegee.

4. The assembly in claim 3 including indicator markings for indicating the angular location of said squeegee mount.

* * * * *